US007082872B2

(12) United States Patent
Goodley

(10) Patent No.: US 7,082,872 B2
(45) Date of Patent: Aug. 1, 2006

(54) STRAP TENSIONING APPARATUS

(75) Inventor: George F. Goodley, Glen Mills, PA (US)

(73) Assignee: Eam-Mosca Corporation, W. Hazleton, PA (US)

( * ) Notice: Subject to any disclaimer, the term of this patent is extended or adjusted under 35 U.S.C. 154(b) by 0 days.

(21) Appl. No.: 10/348,352

(22) Filed: Jan. 21, 2003

(65) Prior Publication Data

US 2004/0140384 A1 Jul. 22, 2004

(51) Int. Cl.
*B65B 13/22* (2006.01)

(52) U.S. Cl. ..... 100/32; 100/2; 100/29; 242/419.7

(58) Field of Classification Search ..... 100/2, 100/5, 8, 26, 29, 32, 33 PB; 53/399, 582, 53/589; 242/419.7, 417.3
See application file for complete search history.

(56) References Cited

U.S. PATENT DOCUMENTS

| | | | | |
|---|---|---|---|---|
| 2,578,123 | A | 12/1951 | Bendfelt | 242/155 |
| 2,642,639 | A | 6/1953 | Meighan et al. | 24/68 |
| 3,420,158 | A | 1/1969 | Kobiella | 100/2 |
| 3,566,778 | A | 3/1971 | Vilcins | 100/2 |
| 4,011,807 | A * | 3/1977 | Kobiella | 100/2 |
| 4,050,372 | A | 9/1977 | Kobiella | 100/2 |
| 4,177,724 | A | 12/1979 | Johnson, III et al. | 100/26 |
| 4,218,969 | A | 8/1980 | Kasuga | 100/32 |
| 4,605,456 | A * | 8/1986 | Annis, Jr. | 156/157 |
| 6,367,376 | B1 * | 4/2002 | Bobren | 100/8 |
| 6,463,848 | B1 * | 10/2002 | Haberstroh et al. | 100/32 |
| 6,708,606 | B1 * | 3/2004 | Bell et al. | 100/32 |

FOREIGN PATENT DOCUMENTS

| | | |
|---|---|---|
| DE | 3525647 A1 | 1/1987 |
| EP | 0203278 A2 | 12/1986 |
| EP | 1055602 A2 | 11/2000 |

* cited by examiner

*Primary Examiner*—Derris H. Banks
*Assistant Examiner*—Jimmy T. Nguyen
(74) *Attorney, Agent, or Firm*—Robert S. Lipton, Esq.; Lipton, Weinberger & Husick

(57) ABSTRACT

The present invention is an apparatus for applying high tension to strap in an automatic strapping machine. A rotatable frame has a first and a second position. Two driving wheels are mounted on the frame. In the first position of the rotatable frame, strap passes freely through a gap between the two driving wheels to allow feeding of the strap around an object and take-up of excess strap. In the second position of the rotatable frame the strap frictionally engages the periphery of the two driving wheels. Rotation of the two driving wheels when the rotatable frame is in the second position places high tension on the strap.

23 Claims, 11 Drawing Sheets

STRAP TENSIONING APPARATUS

BACKGROUND OF THE INVENTION

1. Field of the Invention

The present Invention is an apparatus for tensioning a strap in a strapping machine, such as a high-speed automatic strapping machine. The tensioning apparatus is used to draw a high tension on the strap to securely hold the strap around an object. The present Invention also is a strapping machine incorporating the disclosed tensioning apparatus.

2. Description of the Related Art

Automatic strapping machines are known in the art for placing plastic strap around a package or other object(s) to be strapped for the purpose of reinforcing the package or binding several objects together. In operation, an automatic strapping machine feeds plastic strapping material at high speed around an object to be strapped to form a loop of strap. The strapping machine then secures a first end of the loop of strap and takes up excess strap. The strapping machine places a high tension on the strap, cuts the strap, and secures the strap by welding or other conventional means, completing the strapping of the object and creating a new first end of the strapping material, ready to strap a new object.

The operations performed by a modern strapping machine occur very quickly. A modern strapping machine may feed strap at a speed of fifteen feet per second or higher around the object to be strapped. The strap generally travels through the strapping machine and around the object to be strapped through guides. The steps of securing the first end of the strap, tensioning of the strap, cutting the strap and welding the tensioned loop of strap likewise occur very quickly.

SUMMARY OF THE INVENTION

The mechanism of the present Invention takes up excess strap and properly tensions the strap in an automatic strapping machine in preparation for cutting and welding the strap. The present Invention moves the strap between two different strap paths through the tensioning apparatus: a first, or feed/take-up strap path and a second, or tensioning strap path. In the first strap path, strap may be fed or taken up in a relatively straight line through the tensioning apparatus with no or minimal contact between the strap and the tensioning apparatus.

In the second strap path, the strap is elastically bent around a strap-engaging surface of a strap-engaging member, partially wrapping the strap around the strap engaging member. The strap-engaging member may comprise a belt, wheel or any other object that may frictionally engage a strap. The tensioning apparatus may include one or more strap-engaging members. An initial tension is applied to the strap. The initial tension applied to the strap causes the strap to apply force to the strap-engaging surface of the strap-engaging member because of the partial wrap of the strap around the strap-engaging member. The force applied by the strap to the strap-engaging surface creates frictional engagement between the strap-engaging surface and the strap. The frictional engagement between the strap-engaging surface and the strap allows the strap-engaging member to apply tension to the strap. The tension applied to the strap by the strap-engaging member causes the strap to exert more force against the strap-engaging member, increasing the frictional engagement between the strap and the strap-engaging member and allowing the strap-engaging member to apply additional tension to the strap until a predetermined high tension is achieved. At the conclusion of the tensioning process, the present invention moves the strap from the second, or tensioning strap path to the first, or feed/take-up strap path, readying the strapping machine to feed strap around a new object to be strapped.

The first embodiment of the tensioning apparatus of the present Invention comprises two wheels (hereinafter referred to as the first and second driving wheels) rotatably attached to a rotatable frame. The rotatable frame has a first and a second position. When the rotatable frame is in the first position, the strap may pass freely through a gap between the first and second driving wheels to allow the feed of strap around the object and to allow take-up of excess strap.

When tension is to be applied to the strap, the rotatable frame rotates to the second position. The rotation of the rotatable frame to the second position causes the strap-engaging surfaces of the first and second driving wheels to touch the strap, but not to operably engage the strap. An initial tension is placed on the strap by engagement of the first driving wheel and a driving wheel nip followed by rotation of the first driving wheel. For purposes of this application, a 'nip' is an object that presses the strap against a wheel for the purpose of applying force to the strap and wheel so that the wheel may frictionally engage the strap. Alternatively, the initial tension may be placed on the strap by the take-up assembly or by the take-up assembly in cooperation with a driving wheel nip. The initial tension applied to the strap causes the strap to exert force against, and to frictionally engage, the strap-engaging surfaces of the first and second driving wheels. The first and second driving wheels then are rotated and the frictional engagement between the strap and the surfaces of the first and second driving wheels pulls the strap and places the strap under high tension.

A friction drive mechanism may be used to accommodate the change in length of the strap path caused by movement between the first and second strap paths. The feeding of the strap to form the loop around the object to be strapped, the securing of the free end of the strap, and cutting and welding of the strap all may be performed by conventional means.

DESCRIPTION OF AN EMBODIMENT

Figure 1:
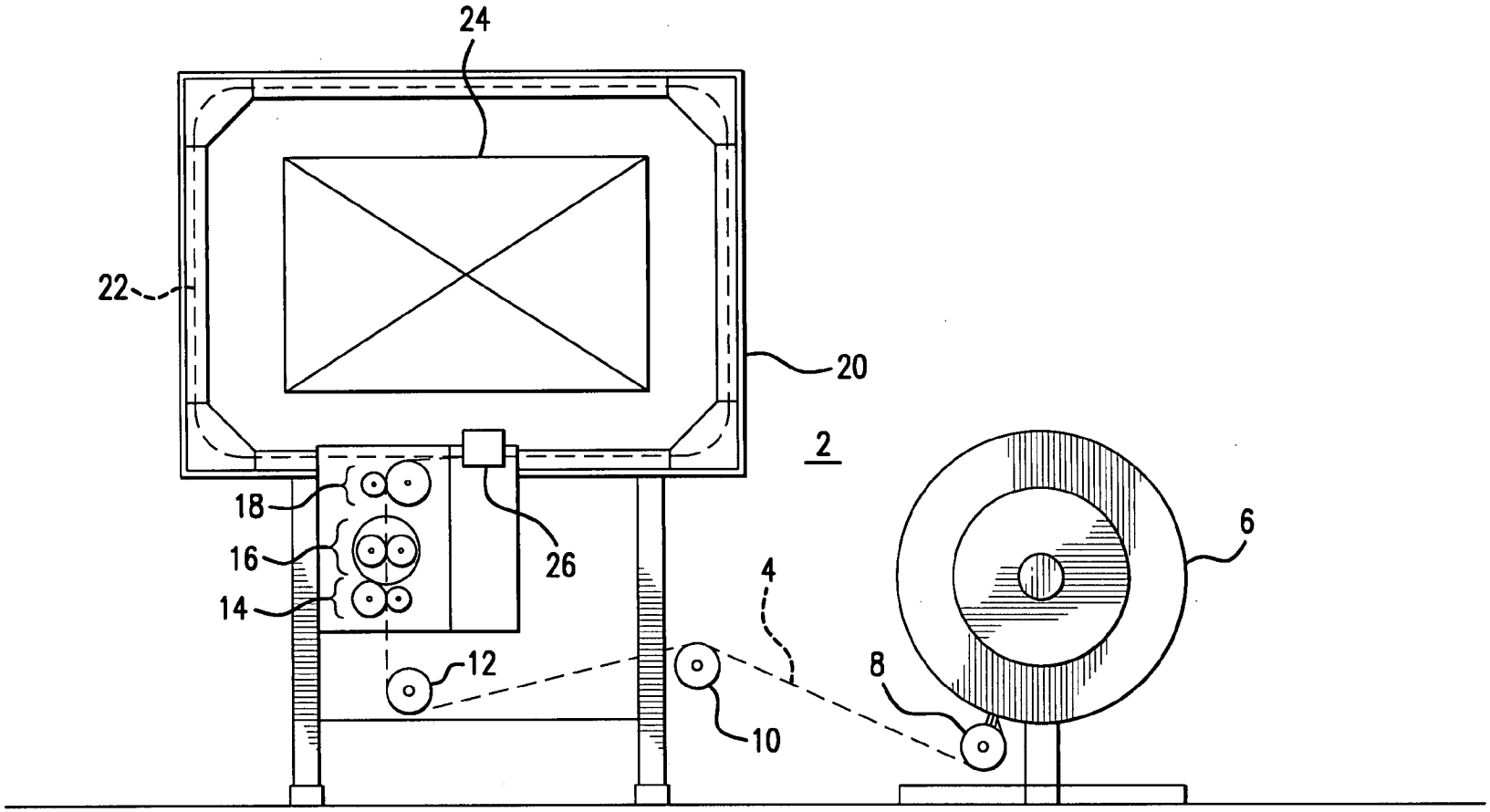
FIG. 1 is a schematic diagram of a strapping machine.

FIGS. 1–17 show a first embodiment of the Invention. As shown by FIG. 1, a strapping machine 2 pulls strap 4 (indicated by dashed line) from strapping roll 6 past idler rollers 8, 10 and 12. The strap 4 is pulled past disengaged take-up assembly 14 and disengaged tensioning assembly 16 by feed assembly 18. Strap 4 is fed through guides 20 so that a loop 22 of strap 4 is formed around the object to be strapped 24. The free end of the strap 4 is secured by conventional securing means by securing-cutting-welding assembly 26. Completion of loop 22 causes feed assembly 18 to disengage strap 4. Take-up assembly 14 engages strap 4 and takes up excess strap 4. Take-up assembly 14 then disengages and the tensioning assembly 16 engages and applies high tension to the strap 4 around the object to be strapped 24. The strap 4 is cut and welded by securing-cutting-welding assembly 26, finishing the operation.

The present Invention addresses specifically tensioning assembly 16 for applying a high tension to the strap 4. The present Invention also addresses means for taking up excess strap 4. Means for feeding strap 4 around an object to be strapped 24 are well known in the art, as are means for securing the free end of the strap 4, means for cutting the strap 4 and means for welding the strap 4.

Figure 2:
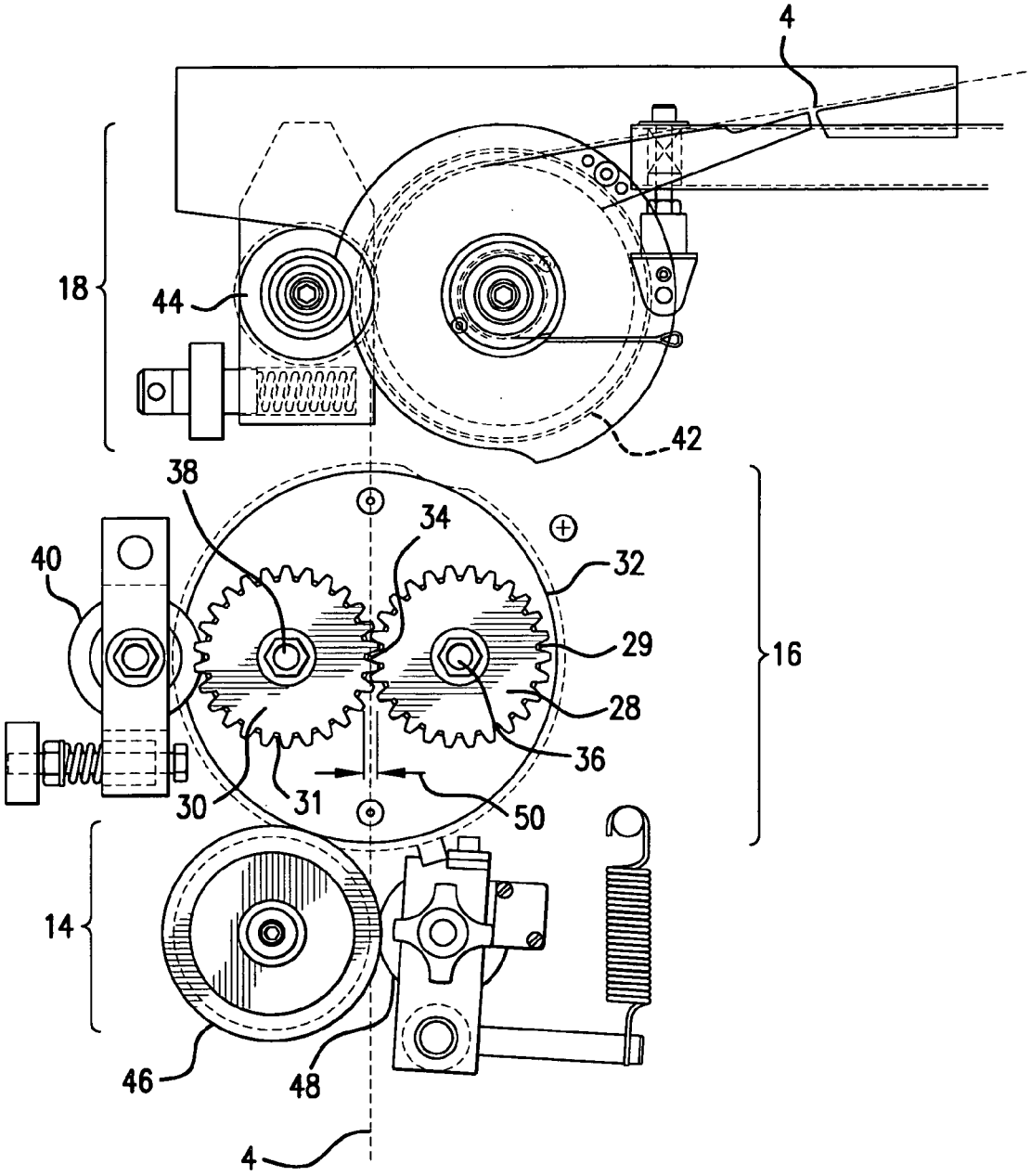
FIG. 2 is a diagram showing the relationship of the tensioning mechanism of the present Invention to the take-up and feed mechanisms in a strapping machine.

FIG. 2 shows the physical relationship of the tensioning assembly 16 of the first embodiment to feed assembly 18 and take-up assembly 14. Strap 4 is indicated by a dashed line in FIG. 2. In the present Invention, either of two strap paths through the tensioning apparatus may be selected: a feeding/take-up strap path (also referred to herein as a first strap path), and a tensioning strap path (also referred to herein as a second strap path). FIG. 2 shows strap 4 in the first, or feed/take-up strap path.

From FIG. 2, tensioning assembly 16 has a first driving wheel 28 having a strap-engaging surface 29 and a second driving wheel 30 having a strap-engaging surface 31 mounted on a rotatable frame 32. Rotatable frame 32 is rotatable through approximately 180 degrees. The axis of rotation 34 of the rotatable frame 32 is located approximately half way between the centers of rotation 36, 38 of the driving wheels 28, 30. The driving wheels 28, 30 are equipped with a driving wheel 'nip' 40.

Certain other parts of the strapping machine are shown by FIG. 2. Those parts include the feed assembly 18 comprising a feed wheel 42 and its corresponding feed nip 44. Take-up assembly 14 is shown on FIG. 2 and comprises a take-up wheel 46 and a take-up nip 48. All wheels 28, 30, 40, 42, 44, 46, 48 are slightly wider than the strap 4. For example, for a one-half inch wide strap 4, the wheels 28, 30, 40, 42, 44, 46, 48 would be about five-eighths of an inch wide.

The sequential operation of the tensioning assembly 16 of the present Invention in a strapping machine 2 is described below making reference to FIGS. 3 through 8.

Figure 3:
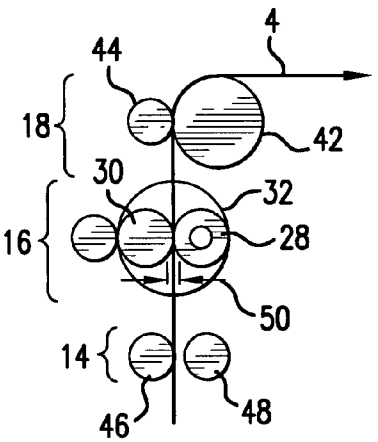
FIG. 3 is a schematic diagram showing the strap tensioning mechanism of the present Invention in a first position during feeding of strap.
Figure 9:
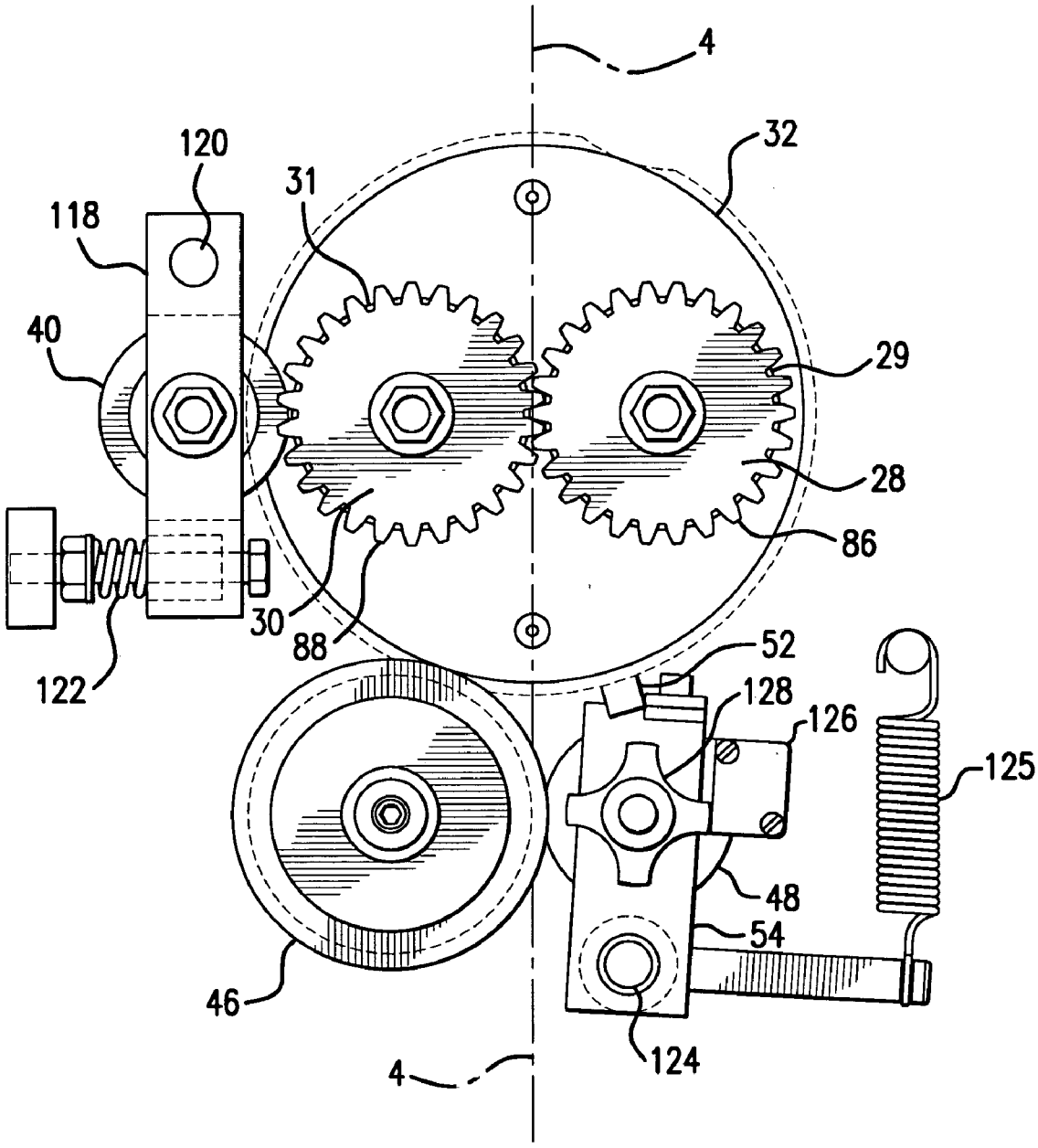
FIG. 9 is a plan view of the tensioning and take-up mechanisms in the feed position.

Strap Feed: FIG. 3 illustrates the feed of strap 4 through the strapping machine 2. FIG. 9 shows more detail of the tensioning assembly 16 and the take-up assembly 14 during strap 4 feed. The position of the rotatable frame 32 as illustrated in FIG. 3 is referred in this application as the "first position," causing the strap 4 to follow the first, or feed/take-up strap path. Strap 4 (shown by the heavy line in FIG. 3) is fed by feed wheel 42 and feed nip 44. The feed nip 44 presses against the strap 4 and feed wheel 42. In FIG. 3, the feed wheel 42, the feed nip 44, or both are driven. In the feed position, take-up nip 48 is separated from strap 4 and thus take-up wheel 46 does not engage strap 4 and exerts no force on strap 4. The driving wheels 28, 30 are oriented so that the strap 4 passes through a gap 50 between the wheels 28, 30. The driving wheels 28, 30 impart no force on the strap 4.

During the feeding of strap 4, the feed wheel 42 is driven at a high rate of speed. The frictional engagement between the feed wheel 42 and the strap 4 propels the strap 4 at a high rate of speed through guides 20 (FIG. 1) around the object to be strapped 24, forming loop 22.

Figure 4:
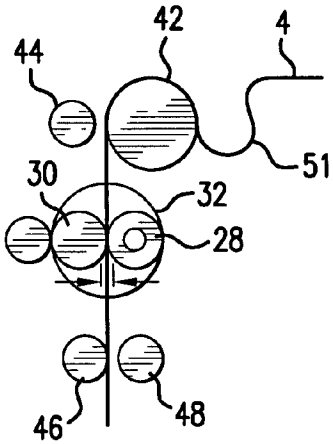
FIG. 4 is a schematic diagram showing the present Invention at the completion of feeding.

Feed Complete: FIG. 4 illustrates the strapping machine 2 after adequate strap 4 has been fed to complete loop 22. Mechanical or electrical sensors may detect the end of the strap 4 or a buckle 51 in the strap 4 or both, indicating that additional strap 4 is not required.

When the loop 22 is complete as detected by the sensors, the feeding of the strap 4 by the feed wheel 42 stops, either by interrupting the rotational motion of the feed wheel 42 or by disengaging the feed nip 44 from the feed wheel 42, thereby reducing the frictional engagement between the feed wheel 42 and the strap 4. In the embodiment illustrated by FIG. 4, the feed nip 44 separates from the feed wheel 42 so that none of the wheels 28, 30, 40, 42, 44, 46, 48 exerts force on the strap 4.

The free end of the strap 4 is then secured by conventional means in securing-cutting-welding assembly 26 (FIG. 1). Conventional means for securing the free end of the strap 4 include use of grippers that receive and hold the free end of the strap 4 and do not release the free end in response to tension applied to the strap 4.

Figure 5:
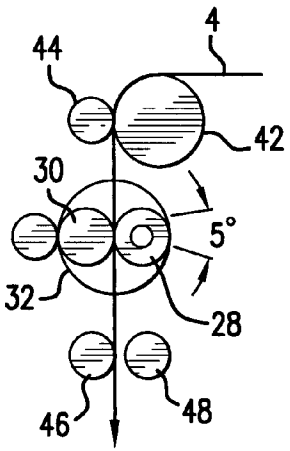
FIG. 5 is a schematic showing fast take-up of excess strap from the object to be strapped.
Figure 10:
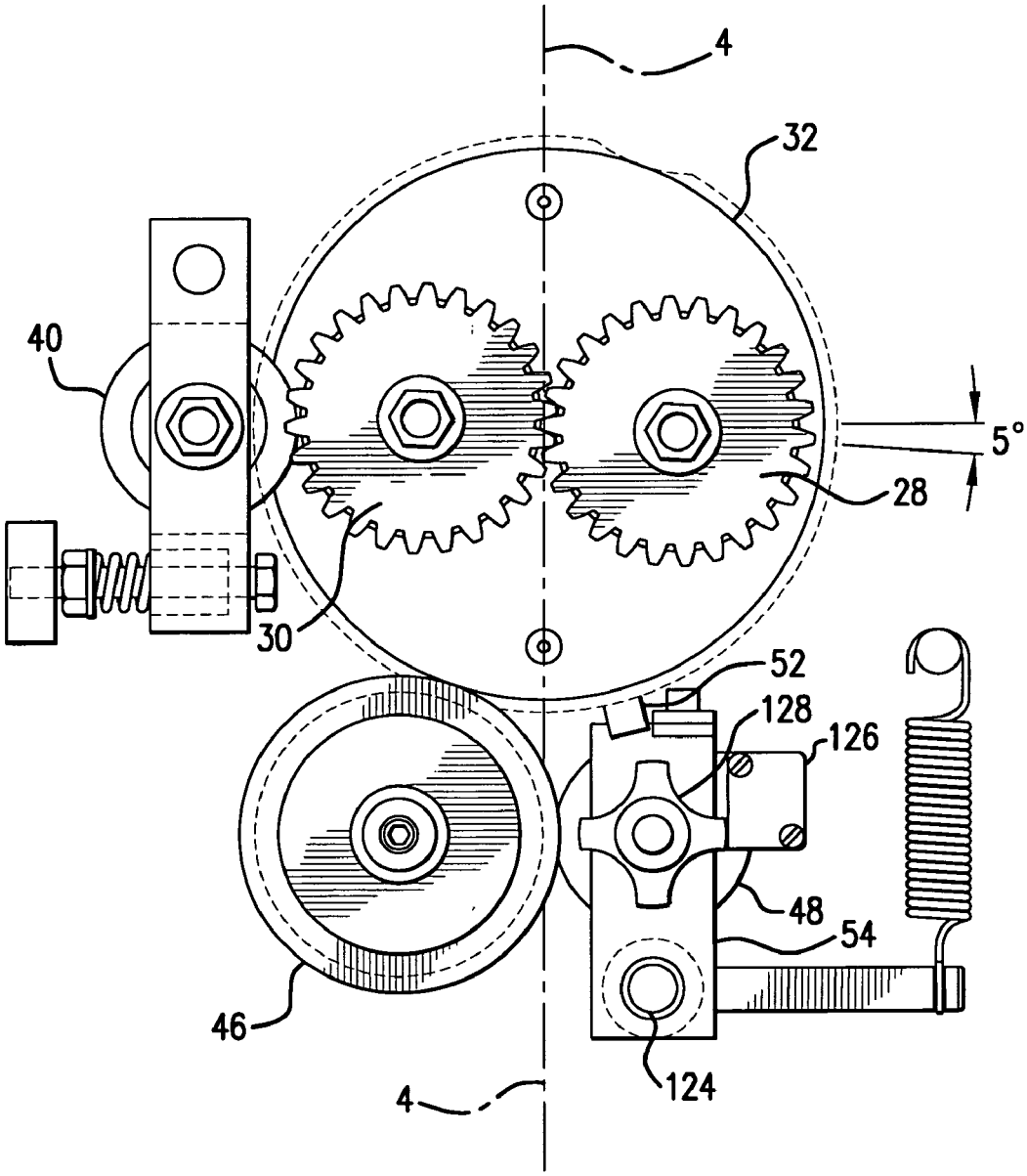
FIG. 10 is a plan view of the tensioning and take-up mechanisms in the take-up position.

Fast take-up: FIG. 5 illustrates one embodiment for the take-up of excess strap 4. FIG. 10 provides more detail of the take-up assembly 14 and tensioning assembly 16 when strap 4 is being taken up. Take-up of excess strap 4 may be performed by take-up wheel 46 and take-up nip 48. The rotatable frame 32 rotates approximately five degrees clockwise.

The movement of the rotatable frame 32 does not materially change the relationship between the driving wheels 28, 30 and the strap 4. The strap 4 still follows the first, or feed/take-up strap path and strap 4 still may pass freely through the gap 50 (FIG. 2) and the driving wheels 28, 30 impart no force on strap 4. The rotatable frame 32 is operably connected to the take-up wheel 46 or take-up nip 48 so that motion of the rotatable frame 32 by approximately five degrees as illustrated by FIG. 5 causes one or both of take-up wheel 46 and take-up nip 48 to move until take-up wheel 46 and take-up nip 48 engage the strap 4. The take-up wheel 46 then is powered and pulls the excess strap 4 in the direction of the arrow indicated by FIG. 5. Optionally, feed nip 44 may move toward feed wheel 42, thereby engaging the strap 4 and guiding strap 4. Feed nip 44 and feed wheel 42 are not powered and are free-wheeling and thus impart no pulling force on the strap 4. When sufficient excess strap is removed, the power to the take up wheel 46 is cut, stopping the rotation of take up wheel 46.

One mechanism for separating take-up wheel 46 and take-up nip 48 and thereby interrupting frictional engagement between the take-up wheel 46 and the strap 4 is a projection 52 (FIGS. 9, 10) on the rotatable frame 32 to engage and disengage the take-up nip frame 54. When the rotatable frame 32 is in the first, or feed, position, the projection 52 may restrain the motion of the take-up nip frame 54 and hence the take-up nip 48, thereby preventing the take-up nip 48 from engaging the strap 4 and take-up wheel 46. When the rotatable frame 32 moves out of the first position, the projection 52 allows the take-up nip 48 to engage the take-up wheel 46, thereby allowing the take-up wheel 46 to frictionally engage the strap 4 and to take up excess strap 4.

As described above, the taking-up of excess strap 4 may be selectably accomplished by selectably turning the take-up wheel 46. As a first alternative, feed wheel 42 and feed nip 44 may remain in engagement during take-up (FIG. 3) and may be powered in a reverse direction and cooperate with take-up wheel 46 for purposes of excess strap 4 take-up. When the excess strap 4 is taken up, feed wheel 42 and feed nip 44 may continue to rotate and slip or stall on the strap 4, imparting a low tension on the strap 4 as seen by the object to be strapped 24.

As a second alternative for take-up of excess strap, the drive for the take-up wheel 46 may be designed to slip or to stall at a low tension on the strap 4 when excess strap 4 is removed. If the drive for the take-up wheel 46 is designed to stall and not to slip, allowance is made to allow strap to pass the take-up wheel 46 when the rotating frame 32 moves from the first to the second position (FIGS. 3, 4). The take-up wheel 46 may be designed to slip enough to allow the strap 4 to pull past. Alternatively, take-up wheel 46 may be provided with clutches to allow motion of rotatable frame 32 from the first to the second position to overcome the strap 4 tension allowed by the clutches and to pull strap past the take up wheel 46.

As a third alternative for take-up of excess strap 4, the motion of rotatable frame 32 from the first to the second position may begin before all excess strap 4 is taken up by the other components. The strap 4 necessary to create the longer strap 4 path created by the motion of rotatable frame 32 from the first to the second position (FIGS. 6, 7) then would be supplied in whole or part by the excess strap 4 of buckle 51 (FIG. 4).

Figure 6:
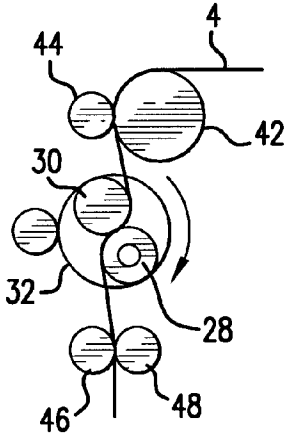
FIG. 6 is a schematic showing the start of rotation of the rotatable frame.

Transition to final tension: FIG. 6 shows the initiation of the rotation of the rotatable frame 32 from the first to the second position and hence the change in the path of strap 4 from the first, or feed/take-up strap path to the second, or tensioning strap path. The strap 4 is maintained in position by the engaged (but free-wheeling) feed wheel 42 and feed nip 44 and by the take-up wheel 46 and take-up nip 48. The motion of the rotatable frame 32 elastically bends the strap 4 around the driving wheels 28, 30, lengthening the strap 4 path and partially wrapping the strap 4 around the strap-engaging surfaces 29, 31 of driving wheels 28, 30. The strap 4 required to create the lengthened strap 4 path is pulled by the rotatable frame 32 and driving wheels 28, 30 assembly past take-up wheel 46 and take-up nip 48. Alternatively, a friction drive 108 (FIG. 17) may feed adequate strap 4 to accommodate the lengthened strap 4 path. The driving wheels 28, 30 are free-wheeling and impart no pulling force on the strap 4.

A sprocket 56 (FIG. 12) and chain drive 58 transfer power from rotatable frame drive motor 60 and hence control the motion of the rotatable frame 32. Alternatively, any suitable means may be used for rotating the rotatable frame 32.

Figure 7:
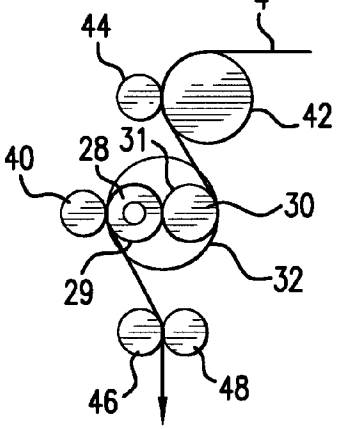
FIG. 7 is a schematic showing the strap tensioning mechanism in the second position and the placing of high tension on the strap.

Final Tension: FIG. 7 shows two steps. In the first step illustrated by FIG. 7, the rotatable frame 32 is fully rotated from the first to the second position. The strap 4 is in full engagement with the strap-engaging surfaces 29, 31 of driving wheels 28, 30. The driving wheels 28, 30 have moved so that a driving wheel nip 40 presses the strap 4 against first driving wheel 28. The driving wheels 28, 30 and driving wheel nip 40 are free-wheeling, and impart no pulling force on the strap 4. The feed wheel 42 and feed nip 44 are in engagement, but still are free-wheeling and impart no pulling force on the strap 4. Take-up wheel 46 and take-up nip 48 still are in engagement and are not powered. Take-up wheel 46 and take-up nip 48 thereby exert no tension on the strap 4.

Figure 11:
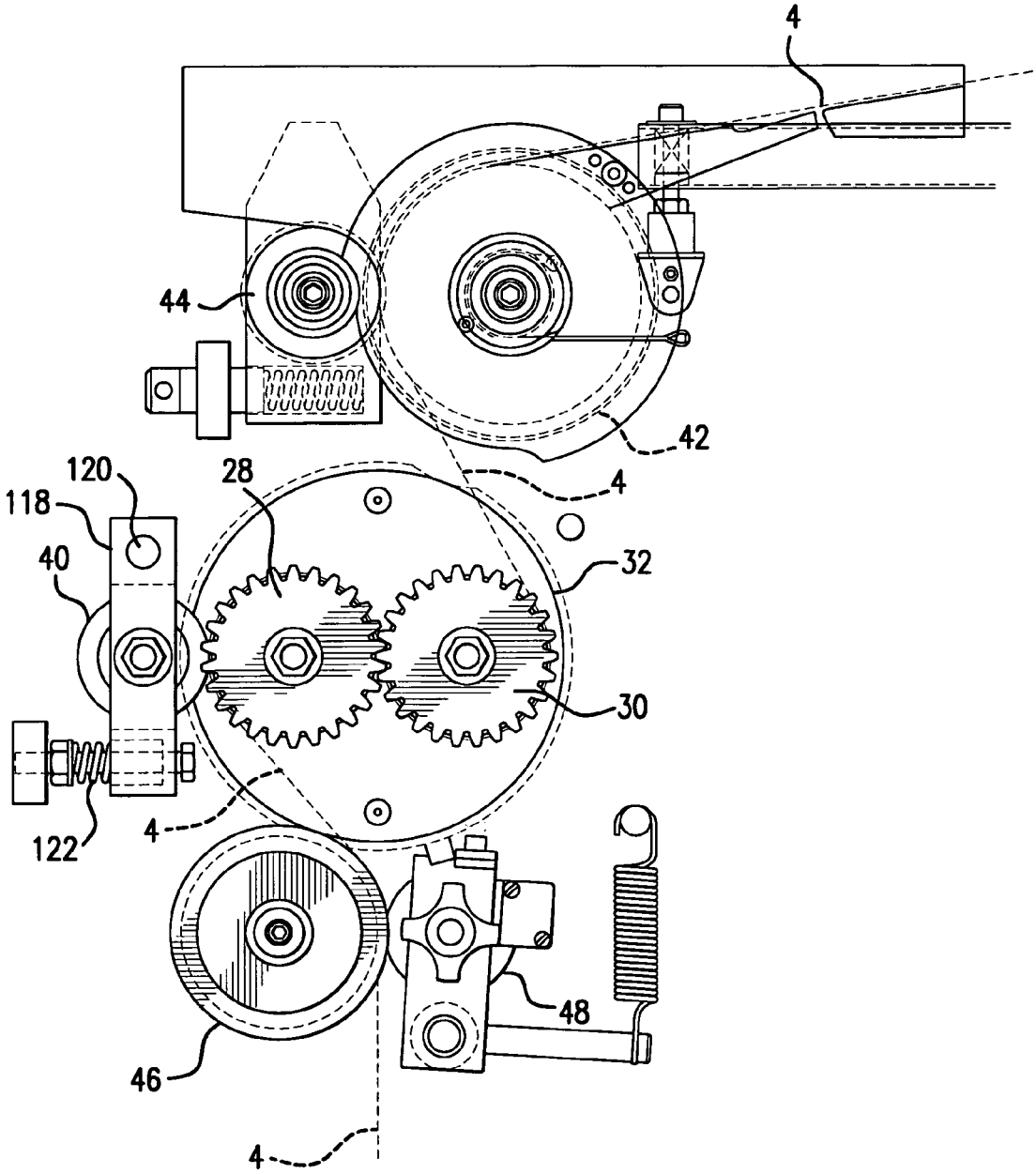
FIG. 11 is a plan view of the feed, tensioning and take-up mechanisms in the tensioning position.

The term "second position" as used in this application refers to the fully rotated position of the rotatable frame 32 as illustrated by FIG. 7. The second strap path (corresponding to the second position) is longer and hence requires more strap 4 than does the first strap path (corresponding to the first position illustrated by FIG. 1). FIG. 11 provides more detail of the tensioning assembly 16 when in the second, or tensioning, position.

In the second step illustrated by FIG. 7, the driving wheels 28, 30 are powered and begin to turn (relatively) slowly and with a high torque. The pressure of the driving wheel nip 40 on the first driving wheel 28 coupled with the large angular contact between the strap 4 and the strap-engaging surfaces 29, 31 of driving wheels 28, 30 allow the driving wheels 28, 30 to exert a large pulling force on the strap 4 in the direction of the arrow shown in FIG. 7, propelling strap through the tensioning apparatus 16. The strap 4 is thereby placed under high tension by the force exerted by the rotating driving wheels 28, 30. The feed wheel 42 and feed nip 44 are still engaged but still are free-wheeling. The take-up wheel 46 and take-up nip 48 still are engaged and may be selectably powered to remove strap exiting the tensioning assembly 16. At an appropriate tension, the driving wheels 28, 30 stop or stall and the strapping cycle is completed by conventional means, including cutting and welding the strap by securing-cutting-welding assembly 26 (FIG. 1).

To prevent the tension of the strap 4 from rotating the rotatable frame 32 as the driving wheels 28, 30 are rotated, a cam 62 (FIGS. 14, 15) activates a latch 64, causing the latch 64 to engage a corresponding opening 66 in the rotatable frame 32, preventing rotation of the rotatable frame 32 in response to tension on the strap 4. When tensioning of the strap 4 is complete and the loop 22 is welded or otherwise fastened, the cam 62 advances, removing the latch 64 from engagement with the opening 66, unlocking the rotatable frame 32 and allowing the rotatable frame 32 to rotate.

Figure 16:
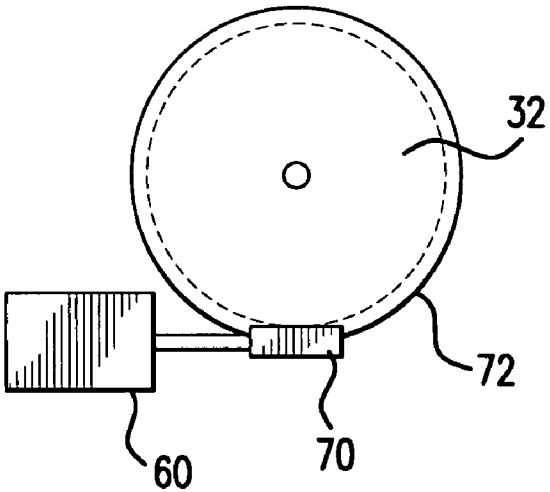
FIG. 16 is a schematic of a worm gear drive for the rotatable frame.

As an alternative and as shown by FIG. 16, the rotatable frame may be moved by a rotatable frame drive motor 60 operating a worm gear 70. The worm gear 70 turns a corresponding gear 72 on the rotatable frame 32. The worm gear 70 alternative is self-locking, and no locking mechanism, such as the latch 64 mechanism of the foregoing alternative, is required.

The greater the angle that the rotatable frame 32 can rotate without mechanical interference, the greater the frictional engagement and the higher the possible tension that can be placed on the strap 4. The angle through which the rotatable frame 32 rotates may be selected to allow application of the desired amount of tension to the strap 4 with the least motion of the rotatable frame 32.

Figure 12:
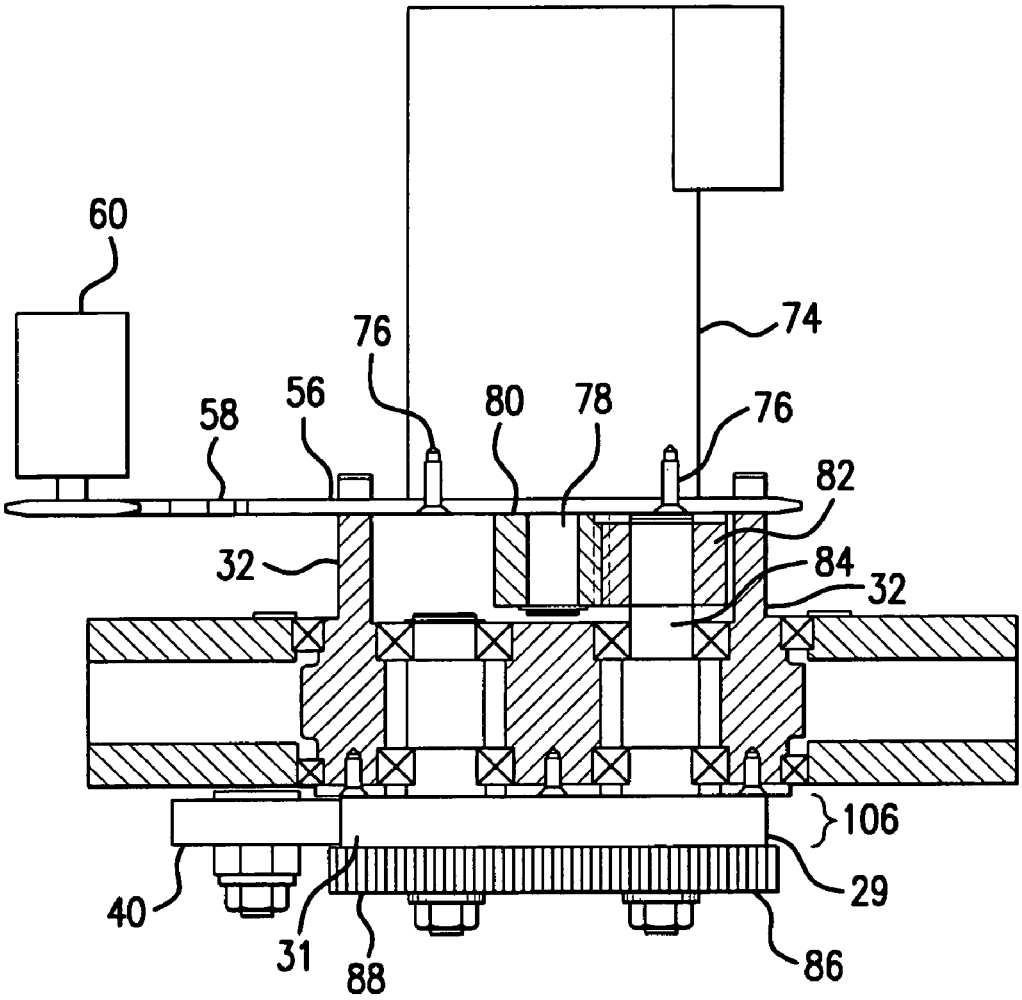
FIG. 12 is a sectional view of a first embodiment of the driving wheel drive mechanism.

A first means for turning the driving wheels 28, 30 appears on FIG. 12. A driving wheel gear motor 74 is mounted directly to the rotatable frame 32 with screws 76. The output shaft 78 of the driving wheel gear motor 74 turns a pinion gear 80 that turns a mating gear 82 on a shaft 84 of the first driving wheel 28. Gear teeth 86 mounted on the periphery of the first driving wheel 28 mate with gear teeth 88 on the periphery of the second driving wheel 30, thereby turning the second driving wheel 30. Gear teeth 86, 88 together define a channel 106 forming the strap-engaging surfaces 29, 31 of driving wheels 28, 30 restraining motion of strap 4.

Figure 13:
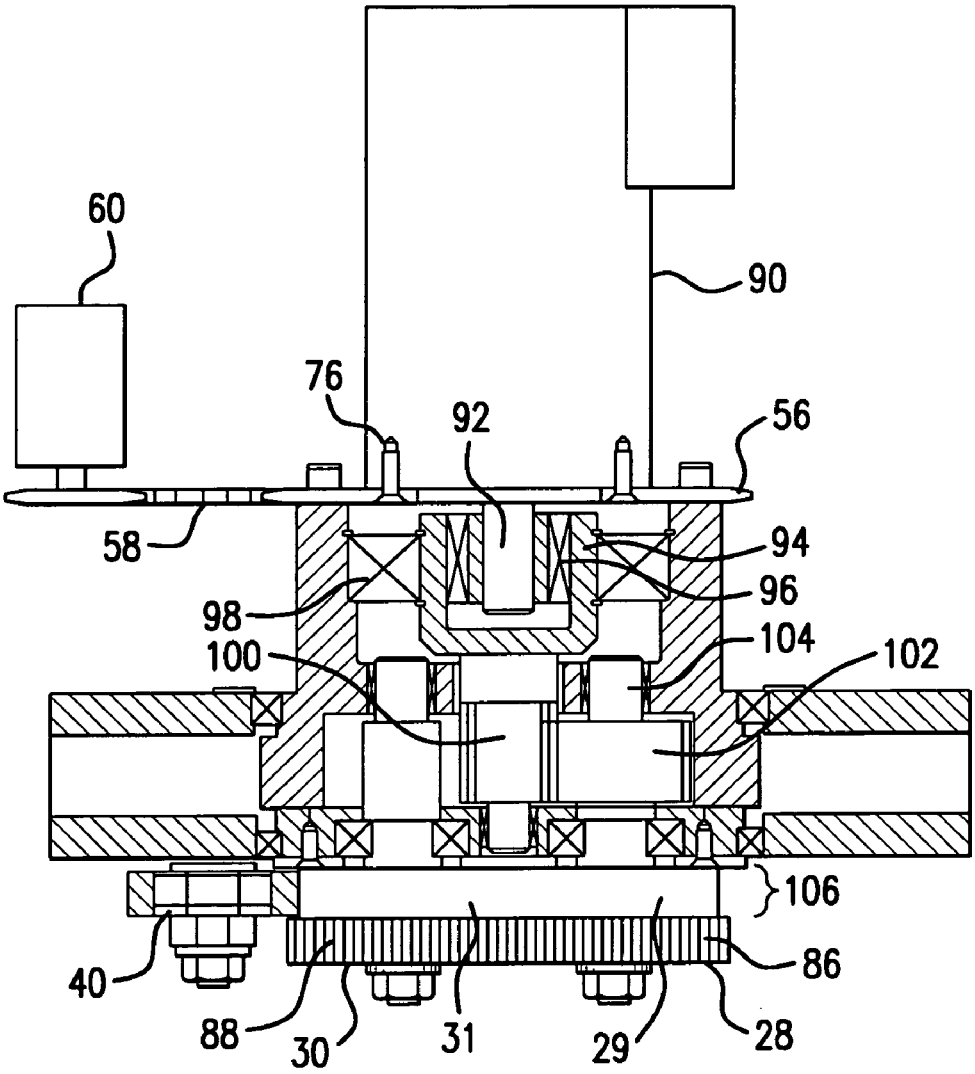
FIG. 13 is a sectional view of a second embodiment of the driving wheel drive mechanism.
Figure 14:
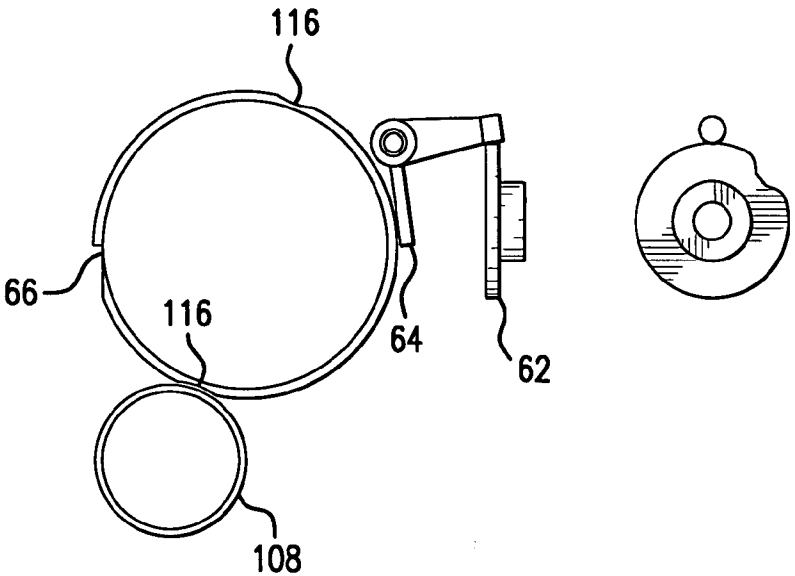
FIG. 14 is schematic of a friction drive and rotatable frame locking mechanism with the rotatable frame in the feed position.
Figure 15:
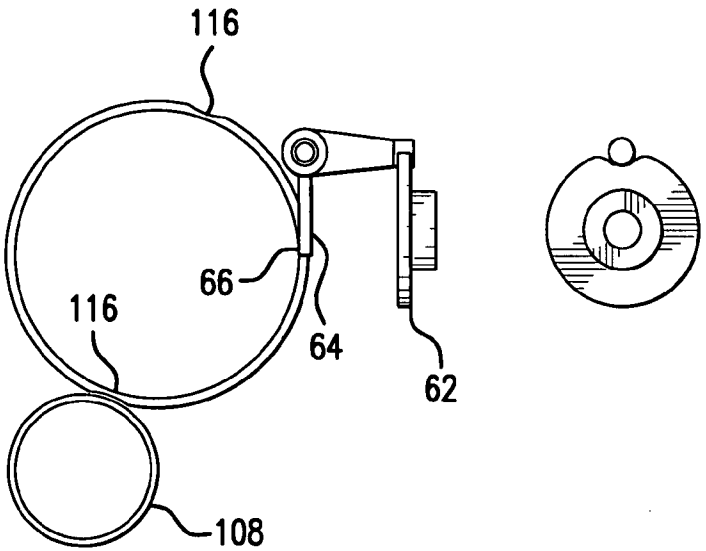
FIG. 15 is a schematic of a friction drive and rotatable frame locking mechanism with the tensioning mechanism in the tensioning position.

A second means for turning the driving wheels 28, 30 is shown by FIG. 13. A driving wheel gear motor 90 drives an output shaft 92. The driving wheel gear motor 90 is mounted on a rotatable frame 32. The driving wheel gear motor output shaft 92 turns a cylinder 94 through an overrunning clutch 96. The cylinder 94 is supporting within the structure of the rotatable frame 32 by cylinder support bearings 98. A pinion gear 100 mounted to the cylinder 94 turns a corresponding gear 102 on the shaft 104 of the first driving wheel 28. The first driving wheel 28 in turn drives the second driving wheel 30 through gear teeth 86, 88 appearing on the periphery of the driving wheels 28, 30. As in the first driving wheel drive means, gear teeth 86, 88 together define a channel 106 forming the strap-engaging surfaces 29, 31 of driving wheels 28, 30 restraining motion of strap 4.

The use of the overrunning clutch 96 (FIG. 13) allows the rotation of the rotatable frame 32 from the feed/take-up position to the tensioning position while fast take-up is underway. Rotation of the rotatable frame 32 during fast take-up will cause the strap-engaging surfaces 29, 31 of driving wheels 28, 30 to frictionally engage the strap 4. In the absence of the overrunning clutch 96, frictional engagement between the driving wheels 28, 30 and strap 4 would prevent fast take-up from occurring. Use of the overrunning clutch 96 allows the driving wheels 28, 30 to spin freely in the direction of take-up, allowing the take-up wheel to complete the take-up of excess strap 4 even though the driving wheels 28, 30 and strap 4 are engaged.

The conventional means for cutting the strap 4 include knives or other sharp edges or heated blades or wires. Conventional means for securing the loop 22 of strap 4 includes welding with heat or friction and the use of clamps.

Figure 8:
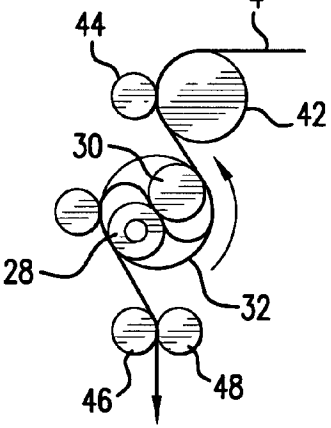
FIG. 8 is a schematic showing return of the rotatable frame to the first position.

Return to feed position: FIG. 8 shows the rotatable frame 32 returning to the feed/take-up position in preparation for feeding more strap 4 for another object to be strapped 24. The rotatable frame 32 may be operably connected to the take-up wheel 46 and take-up nip 48. As the rotatable frame 32 rotates to the first position, the rotatable frame 32 turns the take-up wheel 46 a predetermined number of rotations to take up slack in the strap 4. Once the rotatable frame 32 returns to its first position and the slack is removed from the path of the strap 4, the strapping machine 2 is ready to feed additional strap 4 for another object to be strapped 24 (FIG. 3).

Figure 17:
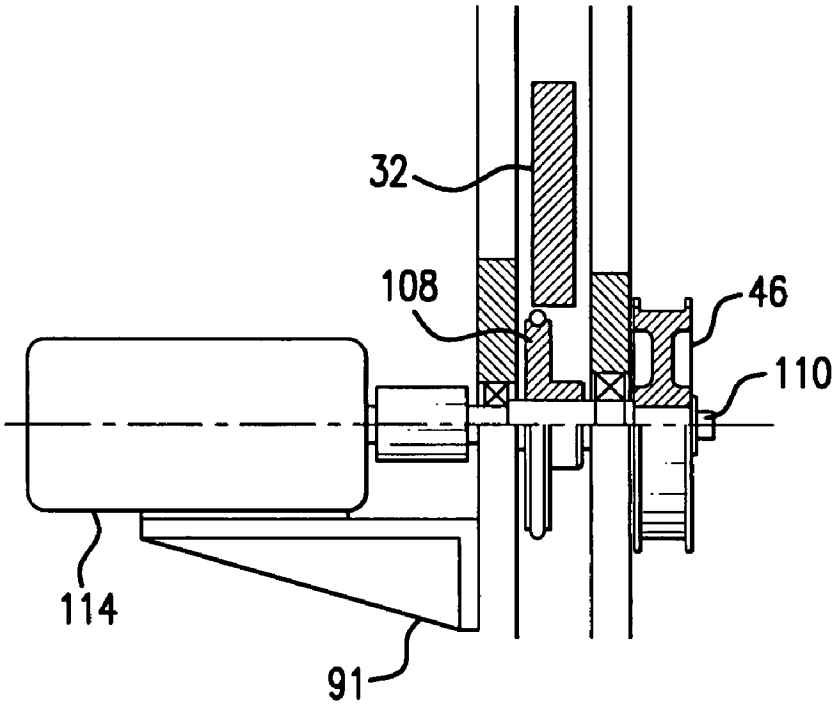
FIG. 17 is a cutaway view of a portion of a friction drive mechanism.

An embodiment of the operable connection between the rotatable frame 32 and take up wheel 46 providing for take-up of excess strap 4 at the conclusion of tensioning is shown by FIG. 17. From FIG. 17, a friction drive 108 is connected to take-up wheel 46 by a common shaft 110. The friction drive 108 frictionally engages the rotatable frame 32 such that the motion of the rotatable frame 32 between the first and second positions and between the second and first positions causes the friction drive 108 to rotate the take-up wheel 46, either feeding or taking up an appropriate amount of strap to accommodate the difference in the length of the strap 4 path between the first, or feed/take-up strap path and the second, or tensioning strap path.

The common shaft 110 (and hence the take-up wheel 46 and friction drive 108) is connected to a take-up drive motor 114. Take-up drive motor 114 is engergized and turns take-up wheel 46 during take-up of excess strap 4 (illustrated by FIGS. 5 and 10). At other times during the strapping cycle, take-up drive motor 114 is not engergized and does not impart force to strap 4.

Indentations 116 (FIGS. 14, 15) prevent friction drive 108 from engaging rotatable frame 32 when rotatable frame is fully rotated to either the first or second position. Take-up drive motor 114 is not energized when rotatable frame 32 is moving between the first and second positions.

FIG. 9 shows construction and operation of the driving wheel nip 40 and take-up wheel nip 48 in the feed position. Driving wheel nip 40 is supported by driving wheel nip frame 118 which swivels on driving wheel nip pin 120. Driving wheel nip spring 122 assembly urges driving wheel nip 40 against second driving wheel 30. In the feed position, driving wheel nip 40 does not engage strap 4 (dashed line) and driving wheels 28, 30 impart no force to strap 4. Take-up nip 48 is supported by take-up nip frame 54, which swivels on take-up nip pin 124. A spring 125 urges take-up nip 48 against take-up wheel 46. In the feed position as shown by FIG. 9, projection 52 prevents take-up nip frame 54 and hence take-up nip 48 from engaging strap 4 and take-up wheel 46. Take-up wheel 46 and take-up nip 48 impart no force on strap 4 in the feed position.

FIG. 10 shows construction and operation of the driving wheel nip 40 and take-up wheel nip 48 in the take-up position. Rotatable frame 32 is rotated clockwise by approximately five degrees, causing projection 52 to release take-up nip 48 so that take-up nip 48 engages strap 4 and take-up wheel 46. Take-up drive motor 114 (FIG. 17) is energized, turning take-up wheel 46 and removing excess strap 4. Detector 126 detects revolution of lobed wheel 128, thereby detecting rotation of the take-up nip 48 and motion of strap 4. Lobed wheel 128 stops rotating when excess strap is taken up and such stoppage is detected by detector 126.

FIG. 11 shows the rotatable frame 32, driving wheels 28, 30 and driving wheel nip 40 in the second, or tensioning, position. Rotatable frame 32 has rotated so that driving wheel nip 40 presses against strap 4 and first driving wheel 28. Driving wheel nip spring 122 determines the force applied by driving wheel nip 40 against strap 4 and first driving wheel 28. Driving wheel 28, 30 drive motor is energized, rotating first driving wheel 28. Gears 86, 88 transfer rotational energy from first driving wheel 28 to second driving wheel 30. Gears 86, 88 also define a channel 106 (FIG. 12) controlling motion of strap 4. Rotation of driving wheels 28, 30 applies high tension to strap 4.

Figure 18:
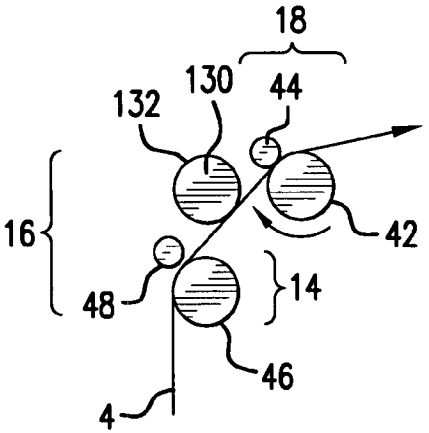
FIG. 18 shows a second embodiment in the feed position.

FIGS. 18 through 23 illustrate the sequential operation of a second embodiment of the Invention. FIG. 18 shows the strap 4 and first alternative take-up, tensioning and feed assemblies 14, 16, 18 in the first, or feed/take-up strap path during feeding of strap 4. Feed wheel 42 and feed nip 44 are engaged, powered, and feed strap 4 in the direction indicated at a high rate of speed. Take-up wheel 46 and tensioning wheel 130 guide strap 4, but are free-wheeling and do not impart force to strap 4.

Figure 19:
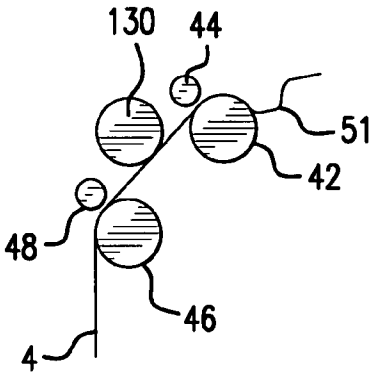
FIG. 19 shows the second embodiment at the completion of feeding.

FIG. 19 shows the completion of feeding for the second embodiment. Mechanical or electrical detectors detect completion of loop 22 (FIG. 1) and separate feed nip 44 from feed wheel 42, thereby interrupting feed of strap 4. Take-up wheel 46 and tensioning wheel 130 continue to guide strap 4, but impart no force on strap 4.

Figure 20:
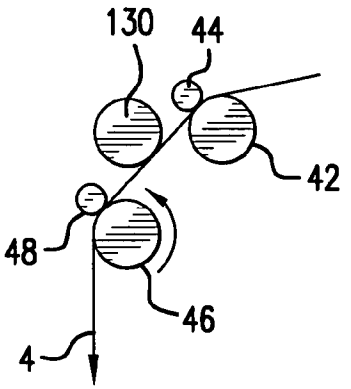
FIG. 20 shows the second embodiment during fast take-up.

FIG. 20 shows the take-up of excess strap for the second embodiment. Take-up nip 48 engages take-up wheel 46 and take-up wheel 46 is powered, pulling strap 4 in the direction indicated. Feed nip 44 engages feed wheel 42 to guide strap 4, but feed nip 44 and feed wheel 42 are not powered and rotate freely, allowing take-up of strap 4 by take-up wheel 46.

Figure 21:
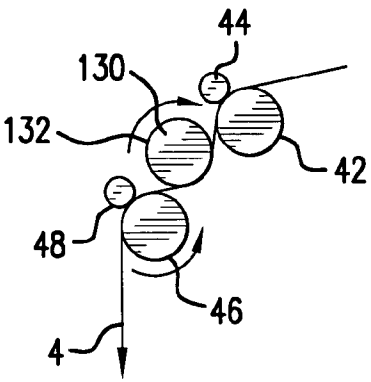
FIG. 21 shows the second embodiment during the transition to final tension.

FIG. 21 shows the transition from the first, or feed/take-up strap path to the second, or tensioning strap path. Tensioning wheel 130 is advanced in a generally rectilinear motion between feed wheel 42 and take-up wheel 46 so that the path of strap 4 is lengthened as strap 4 engages more of the strap-engaging surface 132 of tensioning wheel 130, take-up wheel 46 and feed wheel 42. Take-up wheel 46 or tensioning wheel 130 is powered and rotates to apply an initial tension on strap 4.

Figure 22:
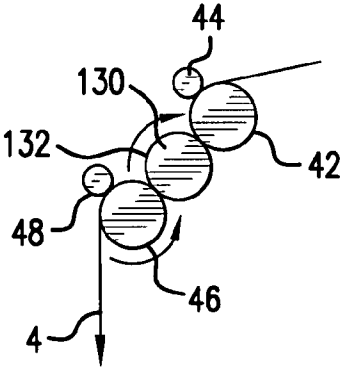
FIG. 22 shows the second embodiment during application of tension.

FIG. 22 shows the tensioning wheel 130 fully engaged with strap 4 and with take-up wheel 46 and feed wheel 42. The strap 4 now follows the second, or tensioning strap path. Tensioning wheel 130 and take-up wheel 46 are powered and turn relatively slowly and with high torque. The frictional engagement between strap 4, the strap-engaging surface 132 of tensioning wheel 130 and take-up wheel 46 allow a high tension to be placed on strap 4, propelling strap 4 through tensioning apparatus 16. Strap 4 then is cut and welded by the securing-cutting-welding apparatus 26 (FIG. 1), completing the strapping operation.

A principal difference between the first embodiment (FIGS. 1–17) and the second embodiment (FIGS. 18-23) is that the second embodiment uses generally rectilinear motion to move between the first strap path and the second strap path while the first embodiment uses rotary motion.

Figure 23:
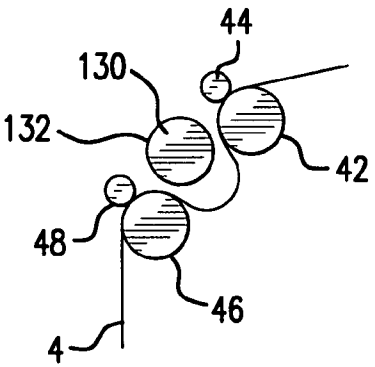
FIG. 23 shows the second embodiment during the return to the feed position.

FIG. 23 shows the tensioning wheel 130 returning to its first position shown by FIG. 18 and returning the strap 4 to the first, or feed/take-up strap path, ready to feed more strap 4 for a new object to be strapped 24 (FIG. 1).

A means for applying tension to a strap 4 of this Invention may comprise one or more rotating wheels (as the driving wheels 28, 30 of the first embodiment or the tensioning wheel 130 of the second embodiment). The frictional engagement may be supplemented by a mechanical engagement; as, for example, the use of toothed or knurled wheels, belt or strap-engaging body to mechanically engage the strap.

For the purposes of this application, a strap path is a distinct course followed by the strap as it moves in either the feed or the take-up direction through the tensioning apparatus. Strap follows the strap path in either the feed direction (toward the object to be strapped) or the take-up direction (away from the object to be strapped). Strap following a strap path does not move in both the feed and take-up directions at the same time.

Many different embodiments of the above invention are possible. This application is intended to address all possible embodiments and is limited only as described in the following claims.

I claim:

1. An apparatus for applying tension to a strap in a strapping machine, the apparatus comprising:

a. a first driving wheel and a second wheel, each of said first driving wheel and said second wheel having an axis of rotation, said axes of rotation of said first driving wheel and said second wheel being substantially parallel, said axis of rotation of at least one of said first driving wheel and said second wheel having a first position and a second position with respect to said axis of rotation of the other of said first driving wheel and said second wheel;

b. said first driving wheel and said second wheel defining a selectable first strap path when said axis of rotation of said at least one of said first driving wheel and said second wheel is in said first position;

c. said first driving wheel and said second wheel defining a selectable second strap path when said axis of rotation of said at least one of said first driving wheel and said second wheel is in said second position;

d. said first driving wheel having a periphery, said periphery of said first driving wheel defining a first strap-engaging surface, said first driving wheel being adapted to rotate;

e. said first strap path being configured such that when said first strap path is selected said first strap-engaging surface does not operatively engage the strap;

f. said second strap path being configured such that when said second strap path is selected the strap is wrapped partially around said periphery of said first driving wheel, said second strap path being further configured such that when a sufficient initial tension is applied to the strap, said initial tension causes the strap to apply a sufficient force to said first strap-engaging surface to cause a frictional engagement between said first strap-engaging surface and the strap, said rotation of said first driving wheel when said first strap-engaging surface is in frictional engagement with the strap tensioning the strap;

g. said second strap path being configured so that the strap does not move in both a feed direction and a take-up direction at the same time during tensioning of the strap.

2. The apparatus of claim 1 further comprising: means for placing said initial tension upon the strap.

3. The apparatus of claim 2 further comprising: means for rotating said first driving wheel.

4. The apparatus of claim 3 further comprising: selection means for selecting said first strap path or said second strap path.

5. The apparatus of claim 4, said means for selecting said first strap path or said second strap path comprising: a rotatable frame, at least one of said first driving wheel and said second wheel being rotatably attached to said rotatable frame, said rotatable frame having a first rotatable frame position defining said first strap path and a second rotatable frame position defining said second strap path; a means to rotate said rotatable frame from said first rotatable frame position to said second rotatable frame position and from said second rotatable frame position to said first rotatable frame position.

6. The apparatus of claim 5 wherein said first driving wheel is rotatably attached to said rotatable frame, said second wheel is a second driving wheel, said second driving wheel is rotatably attached to said rotatable frame, said second driving wheel has a periphery said periphery of said second driving wheel defines a second strap engaging surface, said second driving wheel being adapted for rotation.

7. The apparatus of claim 6 wherein:

a. said periphery of said first driving wheel and said periphery of said second driving wheel together define a gap, said gap being sufficiently large that the strap is able to pass through said gap without engaging said first or said second strap-engaging surface when said rotatable frame is in said first position;

b. said second strap path being configured such that when said second strap path is selected the strap is wrapped partially around said second driving wheel, said second strap path being further configured such that when a sufficient initial tension is applied to the strap, said initial tension causes the strap to apply a sufficient force to said second strap-engaging surface to cause a frictional engagement between said second strap-engaging surface and the strap, said rotation of said second driving wheel in cooperation with said rotation of said first driving wheel when said first and said second strap-engaging surfaces are in said frictional engagement with the strap tensioning the strap; and c. means for rotating said second driving wheel.

8. The apparatus of claim 7 wherein:

a. said rotatable frame has a rotatable frame axis of rotation;

b. said rotatable frame axis of rotation being located substantially between said first driving wheel axis of rotation and said second driving wheel axis of rotation.

9. The apparatus of claim 8 further comprising: means for feeding and for taking up the strap to accommodate motion of said rotatable frame from said first rotatable frame position to said second rotatable frame position and to accommodate motion of said rotatable frame from said second rotatable frame position to said first rotatable frame position.

10. The apparatus of claim 9, said means for feeding and for taking up the strap comprising:

a. a take-up wheel operably connected to said rotatable frame; and b. means for rotating said take-up wheel.

11. The apparatus of claim 10, said means for rotating said take-up wheel comprising: a friction drive connected to said take-up wheel and configured to frictionally engage said rotatable frame such that movement of said rotatable frame from said second rotatable frame position to said first rotatable frame position will rotate said friction drive and said take-up wheel thereby taking up the strap to accommodate motion of said rotatable frame while movement of said rotatable frame from said first rotatable frame position to said second rotatable frame position will rotate said friction drive and said take-up wheel thereby feeding the strap to accommodate motion of said rotatable frame.

12. The apparatus of claim 7, said means for rotating said first driving wheel and said second driving wheel comprising: a driving wheel motor attached to and rotating with said rotatable frame, said driving wheel motor being operably connected to said first and said second driving wheels.

13. The apparatus of claim 12 further comprising: an overrunning clutch, said driving wheel motor being operably connected to said first and said second driving wheels through said overrunning clutch.

14. The apparatus of claim 7, said means for rotating said first driving wheel and said second driving wheel comprising:

a. a first driving wheel gear arrayed on said periphery of said first driving wheel; said first driving wheel gear defining a first driving wheel strap-confining channel on said first driving wheel;

b. a second driving wheel gear arrayed on said periphery of said second driving wheel, said first driving wheel gear and said second driving wheel gear each being configured so as to operably mesh one with the other, said second driving wheel gear defining a second driving wheel strap-confining channel on said second driving wheel.

15. The apparatus of claim 6, said means for applying said initial tension to the strap comprising: a driving wheel nip engaging the strap between said first driving wheel and said driving wheel nip when said rotatable frame is in said second position, said first driving wheel being adapted to rotate to apply said initial tension to the strap.

16. The apparatus of claim 6, said means for applying an initial tension to the strap comprising: a take-up wheel and a take-up nip, said take-up nip and said take-up wheel selectably engaging the strap and being operably connected to said rotatable frame, said take-up wheel or take-up nip rotating to apply said initial tension to the strap.

17. A strapping machine apparatus for tensioning a strap about an object, said strap having a free end, the apparatus comprising:

a. gripping means for selectably gripping the free end of the strap;

b. means for applying an initial tension to the strap against a resistance of said gripping means, said means for applying said initial tension to the strap being adapted to selectably engage the strap;

c. means for applying a final tension to the strap, said means for applying a final tension to the strap being located to selectably engage the strap intermediate between said means for gripping the free end of the strap and said means for applying said initial tension to the strap, said means for applying a final tension to the strap being configured so that no portion of the strap intermediate between said means for gripping the free end of the strap and said means for applying said initial tension to the strap moves in both a feed direction and a take up direction at the same time when said means for applying a final tension to the strap is selectably engaged with the strap and applying tension to the strap.

18. The apparatus of claim 17 said means for applying final tension to the strap comprising:

a. a first selectable strap path, said means for applying final tension to the strap having a first position and a second position, said first selectable strap path being defined by said means for applying final tension to the strap when said means for applying final tension to the strap is in said first position;

b. a second selectable strap path, said second selectable strap path being defined by said means for applying final tension to the strap when said means for applying final tension to the strap is in said second position;

c. selection means for selecting said first selectable strap path or said second selectable strap path;

d. a first driving wheel having a first strap-engaging surface, said first strap path being configured such that when said first strap path is selected by said selection means, said first strap-engaging surface does not operatively engage the strap, said second selectable strap path being configured such that when said second selectable strap path is selected the strap is wrapped partially about said first strap-engaging surface, said second strap path being further configured such that when a sufficient initial tension is applied to the strap, said initial tension causes the strap to apply a sufficient force to said first strap-engaging surface to cause a frictional engagement between said first strap-engaging surface and the strap, said first driving wheel being adapted to rotate, said rotation of said first driving wheel and said frictional engagement between said first strap-engaging surface and the strap placing final tension on the strap.

19. The apparatus of claim 18, said means for selecting said first strap path or said second strap path comprising:

a. a rotatable frame said first driving wheel being rotatably attached to said rotatable frame;

b. a second driving wheel, said second driving wheel being rotatably attached to said rotatable frame, said second driving wheel defining a second strap-engaging surface, said first strap path being configured such that when said first strap path is selected by said selection means, said second strap-engaging surface does not operatively engage the strap, said second selectable strap path being configured such that when said second selectable strap path is selected the strap is wrapped partially about said second strap-engaging surface, said second selectable strap path being further configured such that when said second strap path is selected and when a sufficient initial tension is applied to the strap, said initial tension causes the strap to apply a sufficient force to said second strap-engaging surface to cause a frictional engagement between said second strap-engaging surface and the strap, said second driving wheel being adapted to rotate, whereby said rotation of said first and said second driving wheels and said frictional engagement between said first and said second strap-engaging surfaces and the strap places final tension on the strap.

20. The apparatus of claim 19 wherein said rotatable frame has a first rotatable frame position defining said first strap path and a second rotatable frame position defining said second strap path, the apparatus further comprising: means to rotate said rotatable frame between said first rotatable frame position and said second rotatable frame position and between said second rotatable frame position and said rotatable frame first position.

21. The apparatus of claim 20 wherein said first driving wheel has a first driving wheel periphery, said first driving wheel periphery defining said first strap-engaging surface, said second driving wheel has a second driving wheel periphery, said second driving wheel periphery defining said second strap-engaging surface, said peripheries of said first and said second driving wheels together define a gap, said gap having sufficient dimensions to allow the strap to pass through the gap without engaging said first or said second strap engaging surfaces when said rotatable frame is in said first position.

22. A method for applying tension to a strap around an object comprising the steps of:

a. selecting a first strap path;

b. feeding the strap around the object through the first strap path to form a loop;

c. securing an end of the strap;

d. taking up excess strap;

e. selecting a second strap path, said second strap path being configured such that the strap is wrapped partially around a first driving wheel, said second strap path being further configured such that when a sufficient initial tension is applied to the strap, said initial tension causes the strap to apply a sufficient force to said first driving wheel to provide frictional engagement between the strap and said first driving wheel;

f. applying said sufficient initial tension to the strap;

g. rotating said first driving wheel to apply a final tension to the strap by the frictional engagement of said first driving wheel and the strap in said second strap path, said fianl tension to the strap in said second strap path being further configured so that the strap does not move in both a feed direction and a take-up direction at the same time during tensioning of the strap.

23. The method of claim 22 comprising the further sequential steps of: cutting and welding said strap, thereby preparing the strapping machine to strap a new object.

* * * * *